US011213831B2

(12) United States Patent
Borgström

(10) Patent No.: US 11,213,831 B2
(45) Date of Patent: Jan. 4, 2022

(54) CENTRIFUGAL SEPARATOR HAVING AN OUTLET CHANNEL OF VARYING HEIGHT

(71) Applicant: Alfa Laval Corporate AB, Lund (SE)

(72) Inventor: Leonard Borgström, Tyresö (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 17/251,267

(22) PCT Filed: Jun. 12, 2019

(86) PCT No.: PCT/EP2019/065387
§ 371 (c)(1),
(2) Date: Dec. 11, 2020

(87) PCT Pub. No.: WO2020/001981
PCT Pub. Date: Jan. 2, 2020

(65) Prior Publication Data

US 2021/0245176 A1 Aug. 12, 2021

(30) Foreign Application Priority Data

Jun. 25, 2018 (EP) ..... 18179557

(51) Int. Cl.
*B04B 11/08* (2006.01)
*B04B 1/20* (2006.01)

(52) U.S. Cl.
CPC ..... *B04B 11/082* (2013.01); *B04B 2001/2083* (2013.01)

(58) Field of Classification Search
CPC ..... B04B 11/082; B04B 2001/2083
(Continued)

(56) References Cited

U.S. PATENT DOCUMENTS 2,125,453 A * 8/1938 Hans ..... B04B 11/082 494/43
2,171,136 A 8/1939 Bergner
(Continued)

FOREIGN PATENT DOCUMENTS

CN 1426843 A 7/2003
CN 101415499 A 4/2009
(Continued)

OTHER PUBLICATIONS

"Centrifugal seperators and milk standardization", Dairy Processing Handbook, Chapter 6.2, prior to Aug. 22, 2017, URL: http://dairyprocessinghandbook.com/chapter/centrifugal-separators-and-milk-standardization.

(Continued)

*Primary Examiner* — Walter D. Griffin
*Assistant Examiner* — Shuyi S. Liu
(74) *Attorney, Agent, or Firm* — Birch, Stewart, Kolasch & Birch, LLP

(57) ABSTRACT

A centrifugal separator having a device for the transformation of kinetic energy of a liquid rotating in a discharge chamber around a rotational axis to pressure energy includes a discharge element for the discharge of liquid out of the discharge chamber, which discharge element has a radially outer part shaped as a body of revolution about the rotational axis and is arranged to be located in a rotating liquid body in the discharge chamber, and at least one outlet channel formed in the discharge element and having an inlet opening located in a surface of the body of revolution and elongated in the liquid flow direction, the inlet opening connecting to the interior of an outlet tube via the outlet channel. The outlet channel has a defined axial height and a defined width which vary along their extension from the inlet opening to the connection to the outlet tube in such a way that a defined (Continued)

aspect ratio h/w decreases along at least a part of the extension of the outlet channel. A defined aspect ratio h/w is larger than 1 in an outer first part of the outlet channel and decreases to smaller than 1 in an inner second part of the outlet channel and the height decreases inwardly along the length of the outlet channel.

19 Claims, 2 Drawing Sheets

(58) Field of Classification Search
USPC ..... 494/2, 43, 56, 57, 58, 59, 70, 72, 85; 210/360.1, 369, 372, 373, 776, 781
See application file for complete search history.

(56) References Cited

U.S. PATENT DOCUMENTS

| | | | | |
|---|---|---|---|---|
| 2,230,210 | A | 1/1941 | Brecour et al. | |
| 5,147,280 | A | 9/1992 | Carlsson et al. | |
| 5,160,311 | A * | 11/1992 | Inge ..... | B04B 11/082 494/56 |
| 7,041,045 | B2 | 5/2006 | Thiemann | |
| 9,358,554 | B2 | 6/2016 | Pitkämäki et al. | |
| 2004/0242395 | A1 * | 12/2004 | Thiemann ..... | B04B 11/082 494/56 |
| 2014/0051563 | A1 | 2/2014 | Mackel et al. | |
| 2014/0341714 | A1 | 11/2014 | Casa | |
| 2015/0175439 | A1 | 6/2015 | Quiter et al. | |

FOREIGN PATENT DOCUMENTS

| | | | |
|---|---|---|---|
| CN | 103153474 | A | 6/2013 |
| CN | 104582857 | A | 4/2015 |
| DE | 101 43 405 | A1 | 4/2003 |
| EP | 0 404 923 | A1 | 1/1991 |
| EP | 1323477 | A2 | 7/2003 |
| WO | WO 90/07983 | A1 | 7/1990 |
| WO | WO 2007/114766 | A1 | 10/2007 |

OTHER PUBLICATIONS

International Preliminary Report on Patentability, issued in PCT/EP2019/065387, dated Apr. 24, 2020.
International Search Report, issued in PCT/EP2019/065387, dated Aug. 28, 2019.
Written Opinion of the International Searching Authority, issued in PCT/EP2019/065387, dated Aug. 28, 2019.
English translations of the Chinese Office Action and Search Report, dated Apr. 26, 2021, for Chinese Application No. 201980042494.0.

* cited by examiner

CENTRIFUGAL SEPARATOR HAVING AN OUTLET CHANNEL OF VARYING HEIGHT

AREA OF INVENTION

The present invention relates to centrifugal separators having a device for the transformation of kinetic energy of a liquid rotating in an outlet chamber around a rotational axis to pressure energy. This device comprises an element for the discharge of liquid out of said outlet chamber, which element has a radially outer part shaped as a body of revolution about the rotational axis and arranged to be located in a rotating liquid body in said outlet chamber, at least one outlet channel formed in the element and having an inlet opening located in a surface of the body of revolution and elongated in the liquid flow direction, the inlet opening connecting to the interior of an outlet tube via said outlet channel.

BACKGROUND OF INVENTION

In a centrifugal separator which provided with an energy transformation device of the above form, parts of the rotor of the centrifugal separator form an outlet chamber, in which the liquid rotates. The outlet chamber is arranged to receive a separated liquid continuously from the separation chamber of the centrifugal rotor. This liquid forms a rotating liquid body in the outlet chamber. Centrally in the outlet chamber an outlet device is arranged, through which liquid is discharged out of the outlet chamber and further out of the centrifugal rotor. A centrifugal separator of this kind is shown in EP 0404923, for instance.

In many cases it is important that the energy transformation device can transform as much as possible of the energy stored in the rotating liquid to pressure energy. The maximum pressure which can be achieved is determined by the equation of Bernoulli for the pressure along a flow line of the liquid.

$$P\ \text{stat}+P\ \text{dyn}=\text{constant}$$

The static pressure P stat at the inlet opening is composed of the pressure from the part of the rotating liquid body, which is located radially inside the inlet opening, and the pressure which acts on this part of the liquid body.

The dynamic pressure P dyn is in each point along a flow line determined by the equation $$P\ \text{dyn}=\tfrac{1}{2}\rho W^2$$

in which ρ is the density of the liquid and W being the flow rate of the liquid at the point looked upon.

Outside the inlet opening the liquid has a total pressure which is the sum of the static and dynamic pressure there. However, in the device in a centrifugal separator known by EP 0 404 923 much of the pressure is lost in the bend where the flow direction changes from mainly horizontal to mainly axial.

DISCLOSURE OF INVENTION

The object of the present invention is to provide a centrifugal separator having a device of the kind initially described for the transformation of kinetic energy of a rotating liquid to pressure energy, which device can recover a greater part of the static and the dynamic pressure in the rotating liquid than previously known such devices without involving an increasing risk for the admixture of air in the liquid, and with minimal pressure loss at said change from horizontal, radial to axial flow direction.

It is provided a centrifugal separator having a device for the transformation of kinetic energy of a liquid rotating in a chamber around a rotational axis to pressure energy, comprising an element for the discharge of liquid out of the chamber, which element has a radially outer part shaped as a body of revolution about the rotational axis and arranged to be located in the rotating liquid body, at least one outlet channel formed in the element and having an inlet opening located in a surface of the body of revolution and elongated in the liquid flow direction, the inlet opening connecting to the interior of an outlet tube via said outlet channel, wherein said outlet channel having a defined axial height (h) and a defined width (w) and wherein a defined aspect ratio h/w being larger than 1 in an outer first part of said outlet channel and decreasing to smaller than 1 in an inner second part of said outlet channel and wherein the axial height (h) decreases inwardly along the length of said outlet channel.

The cross-sectional area of the outlet channel is constant or increases along the outlet channel in the direction of flow therethrough.

To make the entrance to the channel effective the h/w is set larger >1 at entrance, preferable in the interval 1.5 to 2. To make the transformation of kinetic energy to pressure effective the channel cross section should be not increased too fast. Also, the flow path change direction from horizontal, mainly radial to mainly axial at the connection between paring disc and the axial outlet channel. The radial extension of the axial channel (ΔR) is for number of practical reasons kept small. In the bend h transforms into ΔR, where ΔR is smaller than h. To make the transition horizontal, radial to axial with minimized pressure loss, h is reduced along flow path in the horizontal, radial part of the channel, while w is gradually increased in such rate that the channel cross section area is constant or gradually increasing. This allows to make the curvature of the bend from horizontal, radial to axial larger as measured relative channel heights or ΔR. This reduces pressure loss at bend horizontal, radial to axial.

One execution is to extend the diffusor to the axial part of the channel.

Said aspect ratio may decrease from between 1.25-2.00 to 0.25-0.75.

Said aspect ratio may decrease from between 1.50-2.00 to 0.40-0.60.

Said decrease may be in an inner second part of said outlet channel, wherein said inner second part is attached to the said outlet tube.

Said inner second part may be extending essentially straight radially inwardly.

The outlet tube may be arranged coaxially around a stationary axial inlet tube.

The inner second part of the outlet channel attaches to the outlet tube by a bend directed upwards with a radius $R_1$.

The height (h) of the outlet channel may decrease by an upper wall of outlet channel which is sloping inwardly along the length of said outlet channel.

Said element may have 2 to 8 outlet channels.

Said element may have 4 to 7 outlet channels.

The cross-sectional area of the outlet channel may gradually increase along the outlet channel in the direction of flow therethrough.

Said cross section of the outlet channel may be substantially rectangular.

Said inlet opening may be formed in an essentially radially facing surface of the element.

The inlet opening may be of one of the following shapes: triangular, NACA duct profile or rectangular shape.

Further aspects of the invention are apparent from the dependent claims and the description.

BRIEF DESCRIPTION OF THE DRAWINGS

Further objects, features and advantages will appear from the following detailed description of several embodiments of the invention with reference to the drawings, in which.

DETAILED DESCRIPTION OF EMBODIMENTS

Figure 1:
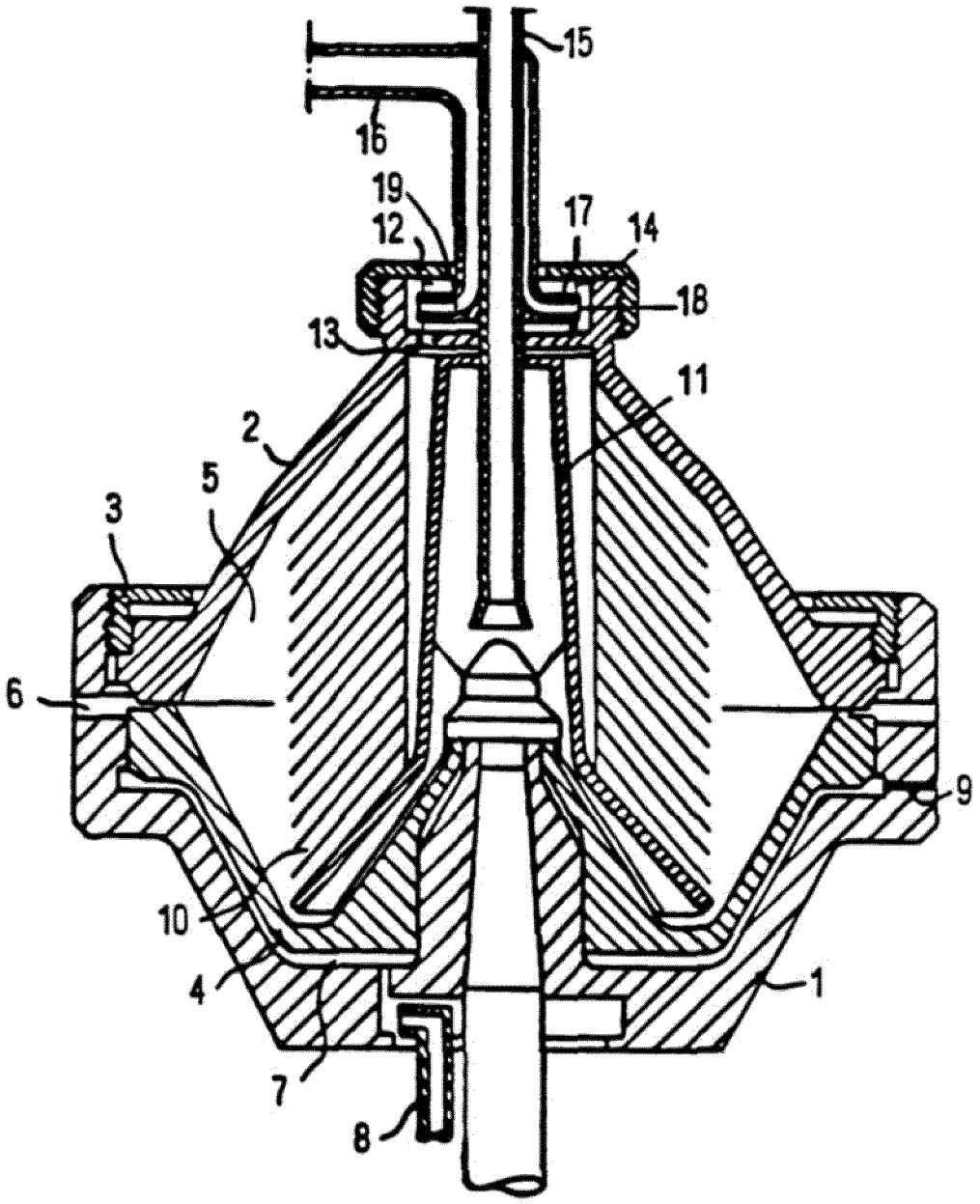
FIG. 1 schematically shows an axial section through a part of a centrifugal separator, which is provided with a device according to the invention, FIG. 2 schematically shows a dimensional view of an embodiment of a part in a device according to the invention.

A centrifugal separator shown in FIG. 1 comprises a rotor having a lower part 1 and an upper part 2 joined together axially by means of a locking ring 3 or in another suitable manner. Inside the rotor shown as an example, there is arranged an axially movable valve slide 4. This valve slide 4 delimits together with the upper part 2 a separation chamber 5 and is arranged to open and close an annular gap towards the outlet openings 6 for a component, which during operation is separated out of a mixture supplied to the rotor and is collected at the periphery of the separation chamber 5. The valve slide 4 delimits together with the lower part 1 a closing chamber 7, which is provided with an inlet 8 and a throttled outlet 9 for a closing liquid.

Inside the separation chamber 5 there is arranged a disc stack 10 consisting of a number of conical separation discs held between a distributor 11 and the upper part 2. The upper part forms at its upper end, as shown in the figure, a ring-formed chamber 12 around the rotational axis, into which chamber 12 in this case a specific lighter liquid component of the mixture can flow from the separation chamber 5 via an inlet 13. The liquid present in the chamber 12 during operation of the rotor forms a rotating liquid body having a radially inwards facing free liquid surface 14.

Centrally through the chamber 12 a stationary inlet tube 15 extends axially, which delivers fluid to be separated into the separation chamber. Around the inlet tube 15 there is arranged a stationary coaxial outlet tube 16 for the specific lighter liquid component collected in the chamber 12.

In the chamber 12, a device for the transformation of kinetic energy of liquid rotating in the chamber 12 to pressure energy is arranged, comprising a discharge element 17, for the discharge of liquid out of the chamber 12, arranged around the inlet tube 15 and connected to the outlet tube 16. The discharge element 17 is stationary but in an alternative outlet arrangement a similar outlet element can be arranged to rotate with a rotational speed which is lower than the rotational speed of the rotor.

The discharge element 17 extends radially outwards and has outside the radial level of the free liquid surface 14 of the rotating liquid body a part, which has at least one inlet opening 18. This inlet opening 18 is connected to the interior of the outlet tube 16 via an outlet channel 19 formed in the discharge element 17. The inlet opening 18 can be of a triangular, NACA duct profile, rectangular or other shape.

Figure 2:
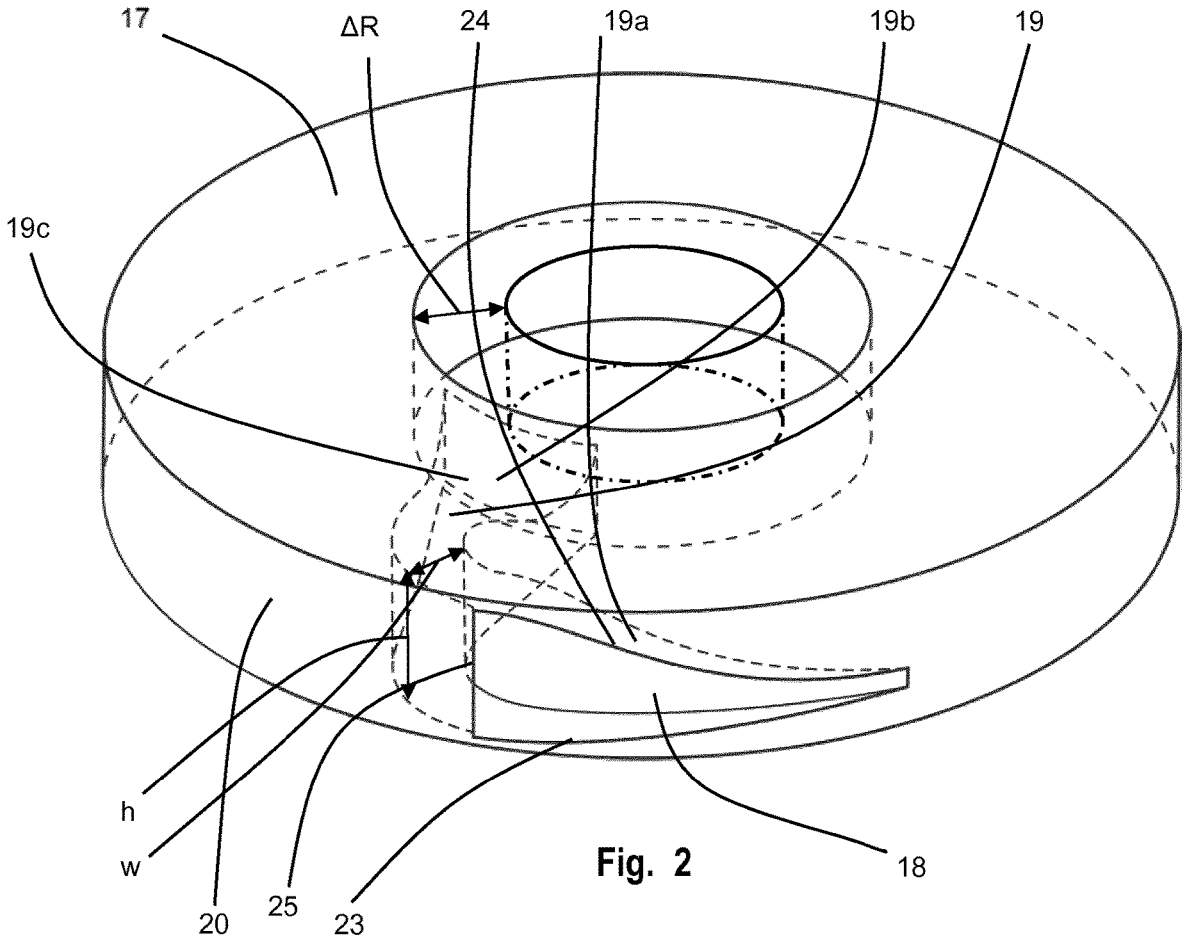

The discharge element 17 shown in FIG. 2 has a radially outer part shaped as a body of revolution about the rotational axis with a circular cylindrical surface 20, which during operation is positioned in the rotating liquid body in the chamber 12 and along which the liquid flows in a predetermined direction. In this example, the inlet opening 18 seen in the flow direction is delimited by two opposite side edges 23 and 24, which diverge from a common point and forward most in the flow direction in a way such that liquid crossing the side edges 23, 24 flows into the inlet opening 18 being scaled off from said free liquid surface 14. Downstream the inlet opening 18 is delimited by a cross edge 25, which is connected to the two side edges 23, 24. In the example shown in this figure, the outlet channel 19 has a confining surface which at the end of the inlet opening 18 meets the edge 25 and forms a smooth continuation of circular cylindrical surface 20 of the discharge element 17.

The outlet channel 19 has a defined height h and a defined width w which vary along its extension from its inlet opening 18 to its connection to said outlet tube 16. The height and the width may be used to define an aspect ratio h/w which thus also vary along the channel extension. It has been discovered that the aspect ratio, and especially the variation of the aspect ratio has an impact on the pressure loss in the discharge element. In FIG. 2, the aspect ratio decreases radially toward the rotational axis. In the portions of the outlet channel 19 where the aspect ratio h/w decreases it is preferred if the decrease is continuous. In the embodiment according to FIG. 2 the inner half of the outlet channel 19 discloses a decrease in the aspect ratio.

The outlet channel 19 comprises an outer first part 19*a* extending circumferentially in the rotational direction with a slight curve inwardly, growing in abruptness, and said inner second part 19*b* attached to the outer first part 19*a*. The inner second part 19*b* is extending essentially straight radially inwardly.

The aspect ratio h/w is larger than 1 in said outer first part 19*a* of said outlet channel 19 and decreases to smaller than 1 in said inner second part 19*b* of said outlet channel 19. The height (h) decreases inwardly along the length of said outlet channel 19.

The aspect ratio may decrease from between 1.25-2.00 to 0.25-0.75, preferably from between 1.50-2.00 to 0.40-0.60.

As can be seen in FIG. 2 the decrease of the aspect ratio is in an inner second part 19*b* of said outlet channel 19.

In order to further bring down pressure losses and unwanted mechanical impact on the streaming liquid the inner second part 19*a* of the outlet channel 19 is attached to the outlet tube 16 by a smooth direction change from radial to axial.

The inner second part 19*b* of the outlet channel 19 attaches to the outlet tube 16 by a bend directed upwards with a radius R1. The height (h) of the outlet channel 19 decreases by an upper wall 19*c* of the outlet channel 19 which is sloping inwardly along the length of said outlet channel 19.

To make the entrance to the channel effective the h/w is set larger >1 at entrance, preferable in the interval 1.5 to 2. To make the transformation of kinetic energy to pressure effective the channel cross section should be not increased too fast. Also, the flow path change direction from horizontal, mainly radial to mainly axial at the connection between paring disc and the axial outlet channel. The radial extension of the axial channel (ΔR) is for number of practical reasons kept small. In the bend h transforms into ΔR, where ΔR is smaller than h. To make the transition horizontal, radial to axial with minimized pressure loss, h is reduced along flow path in the horizontal, radial part of the channel, while w is gradually increased in such rate that the channel cross section area is constant or gradually increasing. This allows to make the curvature of the bend from horizontal, radial to axial larger as measured relative channel heights or ΔR. This reduces pressure loss at bend horizontal, radial to axial.

Said discharge element 17 may have one outlet channel 19 as is disclosed in FIG. 2 but may instead have 2 to 8 outlet channels, preferably 4 to 7 outlet channels 19.

The cross-sectional area of the outlet channel 19 may be chosen to gradually increase along the outlet channel 19 in the direction of flow therethrough.

The cross section of the outlet channel 19 may be substantially rectangular. Other cross section configurations may be possible like triangular, multi-angled or other shapes.

The discharge element 17 may consist of a circular cylindrical disc.

The inlet opening 18 may have triangular, NACA duct profile or rectangular shape but other shapes may be possible.

Said inlet opening 18 is formed in an essentially radially facing surface of the discharge element 17.

In FIG. 2 the discharge element 17 is stationary but embodiments where the discharge element is rotating is possible.

In FIG. 2 the discharge chamber 12 is formed in a part of a rotary body 2 but embodiments where the discharge chamber 12 is formed in a stationary part is possible.

By designing a centrifugal separator having an energy transformation device as described in the above embodiments, the kinetic energy of the rotating liquid can be recovered and transformed into pressure energy much more effectively than has been previously possible.

In all the embodiments described above the inlet openings are formed in a circular cylindrical surface and facing radially. However, the invention is also applicable to devices having inlet openings which face in another direction, for instance axially.

The invention is not limited to the embodiments described above and shown on the drawings, but can be supplemented and modified in any manner within the scope of the invention as defined by the enclosed claims.

The invention claimed is:

1. A centrifugal separator having a device for the transformation of kinetic energy of a liquid rotating in a discharge chamber around a rotational axis to pressure energy, comprising:

a discharge element for the discharge of liquid out of the discharge chamber, the discharge element having a radially outer part shaped as a body of revolution about the rotational axis and arranged to be located in a rotating liquid body in said discharge chamber; and at least one outlet channel formed in the discharge element and having an inlet opening located in a surface of the body of revolution and elongated in the liquid flow direction, wherein the inlet opening connects to an interior of an outlet tube via said at least one outlet channel, wherein said at least one outlet channel has a defined axial height (h) and a defined width (w), wherein a defined aspect ratio (h/w) is larger than 1 in an outer first part of said at least one outlet channel and decreases to smaller than 1 in an inner second part of said at least one outlet channel and the height (h) decreases inwardly along a length of said at least one outlet channel, and wherein the height (h) of the at least one outlet channel decreases by an upper wall of the outlet channel sloping inwardly along the length of said at least one outlet channel.

2. The centrifugal separator according to claim 1, wherein said aspect ratio decreases from between 1.25-2.00 to 0.25-0.75.

3. The centrifugal separator according to claim 1, wherein said aspect ratio decreases from between 1.50-2.00 to 0.40-0.60.

4. The centrifugal separator according to claim 1, wherein said decrease in said aspect ratio is in said inner second part of said at least one outlet channel.

5. The centrifugal separator according to claim 4, wherein said inner second part extends essentially straight radially inwardly.

6. The centrifugal separator according to claim 1, wherein the outlet tube is arranged coaxially around a stationary axial inlet tube.

7. The centrifugal separator according to claim 1, wherein the inner second part of the at least one outlet channel attaches to the outlet tube by a bend directed upwards with a radius $R_1$.

8. The centrifugal separator according to claim 1, wherein said discharge element has 2 to 8 outlet channels.

9. The centrifugal separator according to claim 8, wherein said discharge element has 4 to 7 outlet channels.

10. The centrifugal separator according to claim 1, wherein the cross-sectional area of the at least one outlet channel gradually increases along the outlet channel in the direction of flow therethrough.

11. The centrifugal separator according to claim 10, wherein a cross section of the outlet channel is substantially rectangular.

12. The centrifugal separator according to claim 1, wherein said inlet opening is formed in an essentially radially facing surface of the discharge element.

13. The centrifugal separator according to claim 1, wherein the inlet opening is of one of the following shapes: triangular, NACA duct profile or rectangular shape.

14. A centrifugal separator having a device for the transformation of kinetic energy of a liquid rotating in a discharge chamber around a rotational axis to pressure energy, comprising:

a discharge element for the discharge of liquid out of the discharge chamber, the discharge element having a radially outer part shaped as a body of revolution about the rotational axis and arranged to be located in a rotating liquid body in said discharge chamber; and at least one outlet channel formed in the discharge element and having an inlet opening located in a surface of the body of revolution and elongated in the liquid flow direction, wherein the inlet opening connects to an interior of an outlet tube via said at least one outlet channel, wherein said at least one outlet channel has a defined axial height (h) and a defined width (w), wherein a defined aspect ratio (h/w) is larger than 1 in an outer first part of said at least one outlet channel and decreases to smaller than 1 in an inner second part of said at least one outlet channel and the height (h) decreases inwardly along a length of said at least one outlet channel, and wherein the cross-sectional area of the at least one outlet channel is constant or increases along the outlet channel in the direction of flow therethrough.

15. The centrifugal separator according to claim 14, wherein the cross-sectional area of the at least one outlet channel gradually increases along the outlet channel in the direction of flow therethrough.

16. A centrifugal separator having a device for the transformation of kinetic energy of a liquid rotating in a discharge chamber around a rotational axis to pressure energy, comprising:

a discharge element for the discharge of liquid out of the discharge chamber, the discharge element having a radially outer part shaped as a body of revolution about the rotational axis and arranged to be located in a rotating liquid body in said discharge chamber; and at least one outlet channel formed in the discharge element and having an inlet opening located in a surface of the body of revolution and elongated in the liquid flow direction, wherein the inlet opening connects to an interior of an outlet tube via said at least one outlet channel, wherein said at least one outlet channel has a defined axial height (h) and a defined width (w), and wherein the height (h) decreases inwardly along a length of said at least one outlet channel and the width (w) increases inwardly along a length of said at least one outlet channel.

17. The centrifugal separator according to claim 16, wherein a defined aspect ratio (h/w) is larger than 1 in an outer first part of said at least one outlet channel and decreases to smaller than 1 in an inner second part of said at least one outlet channel.

18. The centrifugal separator according to claim 16, wherein the cross-sectional area of the at least one outlet channel is constant along the outlet channel in a radially inward direction.

19. The centrifugal separator according to claim 16, wherein the cross-sectional area of the at least one outlet channel increases along the outlet channel in a radially inward direction.

* * * * *